US009962985B2

(12) United States Patent
Noguchi et al.

(10) Patent No.: US 9,962,985 B2
(45) Date of Patent: May 8, 2018

(54) RECORDING MEDIUM

(71) Applicant: CANON KABUSHIKI KAISHA, Tokyo (JP)

(72) Inventors: Tetsuro Noguchi, Hachioji (JP); Naoya Hatta, Kawasaki (JP); Kazuhiko Araki, Kawasaki (JP); Arika Tanaka, Yokohama (JP); Shoichi Takeda, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days. days.

(21) Appl. No.: 15/480,196

(22) Filed: Apr. 5, 2017

(65) Prior Publication Data

US 2017/0291443 A1 Oct. 12, 2017

(30) Foreign Application Priority Data

Apr. 8, 2016 (JP) ..... 2016-078261
Apr. 8, 2016 (JP) ..... 2016-078262
Sep. 23, 2016 (JP) ..... 2016-186137

(51) Int. Cl.
*B41M 5/00* (2006.01)
*B41M 5/52* (2006.01)
*B41M 5/50* (2006.01)

(52) U.S. Cl.
CPC ..... *B41M 5/5218* (2013.01); *B41M 5/502* (2013.01); *B41M 5/506* (2013.01); *B41M 5/508* (2013.01); *B41M 5/5227* (2013.01); *B41M 2205/42* (2013.01)

(58) Field of Classification Search
CPC ..... B41M 5/502; B41M 5/506; B41M 5/508; B41M 5/5218; B41M 5/5227
See application file for complete search history.

(56) References Cited

U.S. PATENT DOCUMENTS 8,524,336 B2 * 9/2013 Oguri ..... B41M 5/502 428/212
2006/0045998 A1 * 3/2006 Kitamura ..... B41M 5/506 428/32.24
2014/0234559 A1 * 8/2014 Yumoto ..... B32B 3/10 428/32.18

FOREIGN PATENT DOCUMENTS

JP 61-10483 A 1/1986
JP 7-232473 A 9/1995
JP 8-132731 A 5/1996
JP 9-66664 A 3/1997
JP 9-76628 A 3/1997
JP 2001-1630 A 1/2001

* cited by examiner

*Primary Examiner* — Betelhem Shewareged
(74) *Attorney, Agent, or Firm* — Canon U.S.A., Inc. IP Division

(57) ABSTRACT

A recording medium includes a substrate, and a first and a second ink receiving layer over the substrate in this order from the side close to the substrate. The first ink receiving layer contains fumed silica, alumina, and zirconium compound. In the first ink receiving layer, the mass ratio of the fumed silica to the alumina is in the range of 40:60 to 60:40. The zirconium compound content in the first ink receiving layer is in the range of 0.1% by mass to 3.0% by mass relative to the total mass of the first ink receiving layer. The second ink receiving layer contains inorganic particles including at least one of fumed silica and alumina. In the second ink receiving layer, the fumed silica or the alumina accounts for 80% by mass or more of the inorganic particles in the second ink receiving layer.

18 Claims, No Drawings

RECORDING MEDIUM

BACKGROUND OF THE INVENTION

Field of the Invention

The present disclosure relates to a recording medium.

Description of the Related Art

Recording media including an ink receiving layer containing inorganic particles are used from the viewpoint of increasing the ink absorbency thereof and the image density of the images printed thereon. The ink receiving layer may be formed by applying an ink receiving layer-forming liquid and drying the applied liquid. Unfortunately, the ink receiving layer sometimes cracks during being dried after the application of the ink receiving layer-forming liquid.

Accordingly, the drying of the ink receiving layer is performed at a reduced temperature and a reduced dry air volume, thus reducing the occurrence of cracks. This however reduces productivity.

In order to reduce the occurrence of cracks in the ink receiving layer, Japanese Patent Laid-Open No. 2001-1630 discloses a recording medium including an ink receiving layer containing fumed silica and alumina.

SUMMARY OF THE INVENTION

The present disclosure provides a recording medium allowing image density to be increased while the occurrence of cracks in the ink receiving is reduced, and reducing bronzing.

According to an aspect of the present disclosure, there is provided a recording medium including a substrate, and a first and a second ink receiving layer disposed over the substrate in this order from the side close to the substrate. The first ink receiving layer contains fumed silica, alumina, and zirconium compound. The mass ratio of the fumed silica to the alumina is in the range of 40:60 to 60:40. The zirconium compound content in the first ink receiving layer is in the range of 0.1% by mass to 3.0% by mass relative to the total mass of the first ink receiving layer. The second ink receiving layer contains inorganic particles including at least one of fumed silica and alumina. In the second ink receiving layer, the fumed silica or the alumina accounts for 80% by mass or more of the inorganic particles contained in the second ink receiving layer.

Further features of the present invention will become apparent from the following description of exemplary embodiments.

DESCRIPTION OF THE EMBODIMENTS

According to the research by the present inventors, the recording medium disclosed in Japanese Patent Laid-Open No. 2001-1630 has been improved in reducing the occurrence of cracks, whereas bronzing and decrease in image density occurred. Bronzing is a phenomenon where the image on the recording medium reflects light, thereby seeming to have a metallic luster. The present inventors have conducted intensive research for providing a recording medium that allows image density to be increased and reduces bronzing while the occurrence of cracks in the ink receiving layer is reduced, and finally reached an idea described herein.

The subject matter of the present disclosure will be described in detail in exemplary embodiments.

The present inventors have found that an aggregation produced between the fumed silica and the alumina contained as inorganic particles in the ink receiving layer is effective in reducing the occurrence of cracks in the ink receiving layer.

The reason is not clear, but it can be explained as follows. When an ink receiving layer-forming liquid is applied and then dried, the distance between the fumed silica particles and the alumina particles are reduced by condensation of the ink receiving layer-forming liquid, and thus, the particles of the fumed silica and the alumina are aggregated.

The aggregate of fumed silica and alumina particles formed by such aggregation define relatively large pores in the ink receiving layer. The pores reduce capillary contraction in the ink receiving layer when it is dried, thus reducing the occurrence of cracks in the ink receiving layer.

The present inventors have also found that when the fumed silica and the alumina have approximately the same content as in the case where the mass ratio of the fumed silica to the alumina is in the range of 40:60 to 60:40, such an effect of aggregation becomes largest and makes it difficult to form cracks in the ink receiving layer.

In addition, it has been found that image density is likely to decrease on the ink receiving layer containing fumed silica and alumina, as described above. The present inventors assume that this decrease in image density is due to light scattering by the pores defined by the aggregate of fumed silica and alumina particles. More specifically, it is assumed that the light scattering reduces the transparency of the ink receiving layer, consequently, reducing the image density of the image on the recording medium.

It has not been clear why bronzing is likely to occur at the ink receiving layer containing fumed silica and alumina. When an ink is applied onto a recording medium whose ink receiving layer contains approximately the same amounts of fumed silica and alumina, the coloring material in the ink is likely to form an aggregate. The present inventors assume that the aggregation of the coloring material has a relation with the occurrence of bronzing.

The present inventors have conducted intensive research on a recording medium that allows image density to be increased and reduces bronzing while the occurrence of cracks in the ink receiving layer is reduced, and finally reached an idea described herein.

The present inventors assume that the mechanism for increasing image density and reducing bronzing while reducing cracks is as follows.

The recording medium according to an embodiment of the present disclosure includes a substrate, and a first and a second ink receiving layer over the substrate in this order from the side close to the substrate. The first ink receiving layer contains fumed silica and alumina, and the mass ratio of the fumed silica to the alumina is in the range of 40:60 to 60:40. When a portion (first ink receiving layer) of the ink receiving layer contains fumed silica and alumina with a mass ratio (fumed silica to alumina) in the range of 40:60 to 60:40, the occurrence of cracks in the ink receiving layer can be reduced compared with the case of an ink receiving layer containing inorganic particles of a single compound.

In the second ink receiving layer, on the other hand, fumed silica or alumina accounts for 80% by mass or more of the total mass of the inorganic particles contained in the second ink receiving layer. Hence, the effect of aggregation of fumed silica and alumina is low. Accordingly, the transparency of the second ink receiving layer is not much reduced by light scattering resulting from the aggregate of fumed silica particles and alumina particles, and thus high-density images can be formed.

Also, the first ink receiving layer contains a zirconium compound. The zirconium compound can interact with the hydroxy groups of the fumed silica and the alumina in the first ink receiving layer. Probably, this interaction contributes to reducing the occurrence of cracks in the ink receiving layer.

Also, the zirconium compound interacts with the binder of the ink receiving layer. This interaction hinders the binder from being swelled by the liquid medium of the ink after the ink first has landed on the recording medium, and increases the ink absorbency of the ink receiving layer after the second and subsequent landings. Thus, the zirconium compound is expected to reduce bronzing, which is caused by aggregation of molecules of the coloring material in the ink not absorbed into the uppermost surface of the ink receiving layer and thus deposited.

As just described above, synergistic interactions between the constituents in the recording medium increase image density and reduce bronzing while reducing the occurrence of cracks in the ink receiving layer.

Recording Medium

The recording medium described herein includes a substrate, a first ink receiving layer, and a second ink receiving layer. The recording medium may further include a third ink receiving layer. In this instance, the recording medium has the first, the second, and the third ink receiving layer in this order from the side close to the substrate. The recording medium may be intended for use in ink jet recording.

Each components of the recording medium will be described.

Substrate

The substrate may be composed of only a base paper, or may include a base paper and a resin layer (a base paper coated with a resin). In an embodiment, a substrate including a base paper and a resin layer may be advantageously used. In this instance, although the resin layer may be formed only on one side of the base paper, it is advantageous to form the resin layer on both sides.

Base Paper

The base paper is mainly made of wood pulp, and may optionally contain a synthetic pulp, such as polypropylene, or a synthetic fiber, such as nylon or polyester. Exemplary wood pulp include leaf bleached kraft pulp (LBKP), leaf bleached sulfite pulp (LBSP), needle bleached kraft pulp (NBKP), needle bleached sulfide pulp (NBSP), leaf dissolving pulp (LDP), needle dissolving pulp (NDP), leaf unbleached kraft pulp (LUKP), and needle unbleached kraft pulp (NUKP). These pulps may be used singly or in combination. LBKP, NBSP, LBSP, NDP and LDP, which contain a large amount of short fibers, are advantageous. Pure chemical pulp, such as sulfate pulp or sulfite pulp, is also advantageous. Pulps bleached to increase the whiteness are also advantageous. The base paper may further contain a sizing agent, a white pigment, a reinforcing agent, a fluorescent brightening agent, a moisturizing agent, a dispersant, a softening agent, and other additives, if necessary.

The base paper may have a thickness in the range of 50 μm to 130 μm, such as in the range of 90 μm to 120 μm. The thickness of the base paper mentioned herein is determined by the following procedure. First, the recording medium is cut to expose a section with a microtome, and the section is observed by scanning electron microscopy. The thickness of the base paper is measured at 100 or more randomly selected points, and the average of the measured thicknesses is defined as the thickness of the base paper. The thicknesses of other layers are also determined in the same manner.

The density of the base paper specified in JIS P 8118 is desirably in the range of 0.6 g/cm$^3$ to 1.2 g/cm$^3$. More desirably, it is in the range of 0.7 g/cm$^3$ to 1.2 g/cm$^3$.

Resin Layer

If the base paper is coated with a resin layer, the resin layer may cover a portion of the surface of the base paper. More specifically, the percentage of the resin layer covering the base paper is desirably 70% or more, more desirably 90% or more, and still more desirably 100%. Hence, it is advantageous that the entire surface of the base paper be covered with the resin layer. The percentage of the resin layer covering the base paper is calculated by (area of the surface of the base paper covered with the resin layer)/(entire area of the surface of the base paper).

The resin layer may have a thickness in the range of 20 μm to 60 μm, such as in the range of 35 μm to 50 μm. If the resin layer is formed on both sides of the base paper, it is advantageous that each resin layer have a thickness in such a range.

The resin layer can be made of a thermoplastic resin. Examples of the thermoplastic resin include acrylic resin, acrylic silicone resin, polyolefin resin, and styrene-butadiene copolymer. Among these, polyolefin resin is advantageous. The polyolefin resin mentioned herein refers to a polymer using an olefin as a monomer. More specifically, the polyolefin resin may be a homopolymer or copolymer containing one or more monomers such as ethylene, propylene, and isobutylene. The polyolefin resin may be a single compound or a mixture of two or more polyolefins. Among polyolefins, polyethylene is advantageous. The polyethylene may be a low density polyethylene (LDPE) or a high density polyethylene (HDPE).

The resin layer may contain a white pigment, a fluorescent brightening agent, or ultramarine blue to adjust opacity, whiteness, or hue. In particular, a white pigment is effective in improving the opacity of the recording medium. The white pigment may be titanium oxide in the form of rutile or anatase. In the present embodiment, the white pigment content in the resin layer may be in the range of 3 g/m$^2$ to 30 g/m$^2$. If the resin layer is formed on both sides of the base paper, the white pigment content in each resin layer is desirably in this range. In addition, the ratio of the white pigment to the resin in the resin layer is desirably 25% by mass or less. If the ratio of the white pigment is higher than 25% by mass, the white pigment may not be sufficiently dispersed.

Ink Receiving Layer

The ink receiving layer may be formed by applying ink receiving layer-forming liquids onto the substrate and drying the applied liquids. Each ink receiving layer-forming liquid contains inorganic particles and a binder, and may optionally contain a pigment dispersion, a thickener, a fluidity improving agent, an antifoaming agent, a foam suppressor, a surfactant, a release agent, a penetrant, a coloring pigment, a coloring dye, a fluorescent brightening agent, an ultraviolet absorbent, an antioxidant, a preservative, a fungicide, a water-resistant additive, a dye fixing agent, a curing agent, and a weather-resistant material.

The ink receiving layer disclosed herein includes a first ink receiving layer and a second ink receiving layer in this order from the side close to the substrate. The ink receiving layer may further include another layer in addition to the first and the second ink receiving layer, thus being defined by two or more layers. For example, the ink receiving layer may further include a third ink receiving layer in the order of the first, the second, and the third ink receiving layer from the side close to the substrate. The ink receiving layer may be formed on either or both sides of the substrate. The ink receiving layer may have a thickness in the range of 15 μm to 60 μm, such as in the range of 30 μm to 45 μm.

The thickness of the ink receiving layer mentioned herein refers to the thickness of the fully dried layer and is the average of the cross sections taken at 4 points of the ink receiving layer measured by scanning electron microscopy. In the embodiment disclosed herein, a quadrangular piece of the layer is used for measuring the thickness, and the 4 points are at 1 cm away from each corner toward the barycenter.

The proportion of the thickness of the first ink receiving layer relative to the thickness of the second ink receiving layer (value of (first ink receiving layer thickness)/(second ink receiving layer thickness)) is desirably in the range of 10 to 30. When the proportion of the thicknesses is in this range, cracks in the ink receiving layer can be further reduced.

The second ink receiving layer may have a thickness in the range of 0.5 μm to 3.0 μm. When the thickness of the second ink receiving layer is in this range, cracks in the ink receiving layer can be further reduced.

The first ink receiving layer may have a thickness in the range of 20.0 μm to 40.0 μm, such as in the range of 20.0 μm to 28.0 μm. When the thickness of the first ink receiving layer is in such a range, cracks in the ink receiving layer can be further reduced without reducing the ink absorbency of the ink receiving layer.

The ink receiving layer disclosed herein may have a further layer over the second ink receiving layer, between the first and the second ink receiving layer, or between the substrate and the first ink receiving layer as long as the advantageous effects of the present disclosure can be produced. This further layer may have a thickness in the range of 0.01 μm to 2.0 μm, such as in the range of 0.3 μm to 2.0 μm.

First Ink Receiving Layer

The first ink receiving layer contains alumina particles and fumed silica particles as inorganic particles. In the first ink receiving layer, the mass ratio of the fumed silica to the alumina is in the range of 40:60 to 60:40.

When the mass ratio of fumed silica to alumina is in such a range, cracks in the ink receiving layer can be reduced.

Also, the first ink receiving layer contains a zirconium compound. The presence of the zirconium compound contributes to reducing cracks in the ink receiving layer and bronzing. Advantageously, the zirconium compound content in the first ink receiving layer is in the range of 0.1% by mass to 3.0% by mass relative to the total mass of the first ink receiving layer. When the zirconium compound content is in this range, cracks in the ink receiving layer and bronzing can be further reduced.

The first ink receiving layer may further contain a binder. The proportion of the binder to the inorganic particles in the first ink receiving layer may be in the range of 10.0% by mass to 40.0% by mass, such as in the range of 12.0% by mass to 30.0% by mass. When the binder is contained with such a proportion, the ink absorbency can be increased while cracks in the ink receiving layer is further reduced.

Second Ink Receiving Layer

For the second ink receiving layer, fumed silica or alumina accounts for 80% by mass or more of the total mass of the inorganic particles contained in the second ink receiving layer. When the proportion of fumed silica or alumina to inorganic particles is in such a range, decrease in image density resulting from the aggregation of fumed silica particles and alumina particles can be suppressed.

Also, the second ink receiving layer may contain a zirconium compound from the viewpoint of further reducing the occurrence of cracks in the ink receiving layer.

The second ink receiving layer may further contain a binder. The proportion of the binder to the inorganic particles in the second ink receiving layer may be in the range of 5.0% by mass to 30.0% by mass, such as in the range of 7.0% by mass to 25.0% by mass. When the binder is contained with such a proportion, cracks in the ink receiving layer can be further reduced.

The proportion of the thickness of the first ink receiving layer to the thickness of the second ink receiving layer (value of (first ink receiving layer thickness)/(second ink receiving layer thickness)) is desirably in the range of 10 to 30 from the viewpoint of reducing the occurrence of cracks in the ink receiving layer and increasing image density.

The thickness of the second ink receiving layer is desirably in the range of 0.5 μm to 3.0 μm from the viewpoint of increasing image density and reducing bronzing and cracks in the ink receiving layer.

In the second ink receiving layer, it is more advantageous for increasing ink absorbency that fumed silica accounts for 80% by mass or more of the inorganic particles than that alumina accounts for 80% by mass or more of the inorganic particles.

Third Ink Receiving Layer

The recording medium may further include a third ink receiving layer over the second ink receiving layer.

If the recording medium includes the third ink receiving layer, it is desirable that the third ink receiving layer contain alumina with a proportion of 80% by mass or more to the inorganic particles contained in the third ink receiving layer.

When the third ink receiving layer contains alumina with a proportion of 80% by mass or more relative to the inorganic particles contained in the third ink receiving layer while the second ink receiving layer contains fumed silica with a proportion of 80% by mass or more relative to the inorganic particles contained in the second ink receiving layer, high gloss can be produced.

The present inventors assume that this is because the alumina in the third ink receiving layer has a higher refractive index than the fumed silica in the second ink receiving layer. More specifically, the present inventors assume that this difference in refractive index contributes to: (1) increasing the reflection of light from the third ink receiving layer; and (2) creating a reflection at the boundary between the third ink receiving layer and the second ink receiving layer, and thus helps increase gloss.

In the third ink receiving layer, the proportion of the binder to the total mass of the inorganic particles may be in the range of 10.0% by mass to 30.0% by mass, such as in the range of 7.0% by mass to 25.0% by mass, from the viewpoint of reducing the occurrence of cracks.

The ingredients of the ink receiving layer will now be described.

Inorganic Particles

The average primary particle size of the inorganic particles contained in the ink receiving layer is desirably 50 nm or less. More desirably, it is in the range of 1 nm to 30 nm, such as 3 nm to 20 nm. In the present disclosure, the average primary particle size is defined as the number average of the diameters of circles having an area equivalent to the projected area of the primary particles of the inorganic particles observed under an electron microscope. At this time, at least 100 particles are measured.

Desirably, the inorganic particles are sufficiently dispersed with a dispersant in each ink receiving layer-forming liquid and is thus used in the form of a dispersion liquid. In the dispersion liquid, the average secondary particle size of the inorganic particles in a dispersion liquid may be in the range of 1 nm to 1000 nm and is desirably in the range of 10 nm to 500 nm, such as 50 nm to 300 nm. The average secondary particle size of the inorganic particles in the dispersion liquid can be measured by dynamic light scattering.

The inorganic particle content in the ink receiving layer may be in the range of 50% by mass to 98% by mass, such as in the range of 70% by mass to 96% by mass, relative to the total mass of the ink receiving layer.

Examples of the material of the inorganic particles other than fumed silica and aluminum include colloidal silica, titanium dioxide, zeolite, kaolin, talc, hydrotalcite, zinc oxide, zinc hydroxide, aluminum silicate, calcium silicate, magnesium silicate, zirconium oxide, and zirconium hydroxide. These types of inorganic particles may be used singly or in combination.

The alumina contained in the ink receiving layer may be hydrated alumina or fumed alumina. Hydrated alumina facilitates the formation of an ink receiving layer that can help form high-density images, and is thus advantageous.

The hydrated alumina may be represented by the following general formula (X): $Al_2O_{3-n}(OH)_{2n}.mH_2O$ (n represents 0, 1, 2, or 3, m represents a number of 0 to 10, desirably 0 to 5, and m and n are not simultaneously 0). $mH_2O$ represents an aqueous phase that can be desorbed and is often not involved in the formation of crystal lattices. m is not necessarily integer. Also, m can be changed to 0 by heating the hydrated alumina.

The hydrated alumina can be produced in a known process. More specifically, the hydrated alumina can be produced by hydrolysis of aluminum alkoxide, by hydrolysis of sodium aluminate, or by adding an aqueous solution of aluminum sulfate or aluminum chloride to a sodium aluminate aqueous solution to neutralize the sodium aluminate solution.

The hydrated alumina may be amorphous or may have a crystal structure in the form of gibbsite or boehmite, depending on the temperature of heat treatment. The crystal structure of the hydrated alumina can be analyzed by X-ray diffraction. The hydrated alumina used in the present embodiment is desirably amorphous or in the form of boehmite. Examples of the hydrated alumina include hydrated alumina disclosed in Japanese Patent Laid-Open Nos. 7-232473, 8-132731, 9-66664, or 9-76628, and commercially available hydrated alumina such as Disperal series HP 14 and HP 18 (each produced by Sasol). These types of hydrated alumina may be used singly or in combination.

The specific surface area of the hydrated alumina particles, determined by the BET method, may be in the range of 100 $m^2/g$ to 200 $m^2/g$, such as 125 $m^2/g$ to 175 $m^2/g$. In the BET method, molecules or ions having a known size are adsorbed to the surfaces of a sample, and the specific surface area of the sample is calculated from the amount of adsorbed molecules or ions. In the present disclosure, nitrogen gas is adsorbed to a sample.

Fumed alumina may be γ-alumina, α-alumina, δ-alumina, θ-alumina, or χ-alumina. From the viewpoint of the optical density of the image and the ink absorbency of the recording medium, γ-alumina is advantageously used. Example of fumed alumina include AEROXIDE series Alu C, Alu 130, and Alu 65 (each produced by EVONIK).

The specific surface area of the fumed alumina particles measured by the BET method may be 50 $m^2/g$ or more and is desirably 80 $m^2/g$ or more. Also, it may be 150 $m^2/g$ or less and is desirably 120 $m^2/g$ or less.

The average primary particle size of the fumed alumina particles may be 5 nm or more and is desirably 11 nm or more. Also, it may be 30 nm or less and is desirably 15 nm or less.

In the present disclosure, the alumina may be dispersed with a monovalent acid as a dispersant and used in the form of a dispersion liquid. The alumina particles in such a dispersion liquid desirably have a particle size in the range of 50 nm to 300 nm. The particle size of the alumina in a dispersion liquid can be measured by dynamic light scattering.

In general, the silica contained in ink receiving layers is roughly classified into two types: wet process silica and dry process (fumed) silica, depending on the production process. In a known wet process, a silicate is decomposed into active silica with an acid, and the active silica is polymerized to an appropriate extent and then precipitated by aggregation to yield hydrous silica. In a known dry process, anhydrous silica is produced by high temperature gas phase hydrolysis (flame hydrolysis) of a silicon halide, or a process (arc process) in which silica sand and coke are heated, reduced, and evaporated by arc in an electrical furnace and the evaporated gas phase is oxidized with air.

In the recording medium of the present disclosure, dry process silica, that is, fumed silica, is used. This is because fumed silica particles have particularly large specific area and, accordingly, have high ink absorbency. In addition, fumed silica can impart transparency to the ink receiving layer. Consequently, images formed on such a recording medium can have a high image density. Examples of the fumed silica include AEROSIL (produced by Nippon Aerosil) and Reolosil QS series (produced by Tokuyama).

The specific surface area of the fumed silica determined by the BET method may be in the range of 50 $m^2/g$ to 400 $m^2/g$, such as in the range of 200 $m^2/g$ to 350 $m^2/g$.

Desirably, the fumed silica is dispersed with a dispersant in the ink receiving layer-forming liquid and is thus used in the form of dispersion liquid.

Also, the fumed silica may be used in the form of a dispersion liquid prepared by being dispersed with a dispersant and a cationic polymer mordant. The fumed silica in a dispersion liquid desirably has a particle size in the range of 50 nm to 300 nm.

Examples of the cationic polymer include polyethyleneimine resin, polyamide resin, polyamide-epichlorohydrin resin, polyamine-epichlorohydrin resin, polyamide polyamine epichlorohydrin resin, polydiallylamine resin, and dicyandiamide condensates.

These cationic polymers may be used singly or in combination.

After mixing the fumed silica with the dispersant, the mixture is pulverized into an average particle size of 50 nm to 300 nm with a disperser. The disperser may be selected from known dispersers including a high rotation speed disperser, a medium stirring disperser (such as a ball mill or a sand mill), an ultrasonic disperser, a colloid mill disperser, and a high-pressure homogenizer.

The alumina dispersion liquid and the fumed silica dispersion liquid may contain other ingredients, such as a silane coupling agent or any other surface modifier, a thickener, a fluidity improving agent, an antifoaming agent, a foam suppressor, a surfactant, a release agent, a penetrant, a coloring pigment, a coloring dye, a fluorescent brightening agent, an ultraviolet absorbent, an antioxidant, a preservative, a fungicide, a water resistant additive, a crosslinking agent, and a weather-resistant material.

The dispersion medium for the inorganic particles may be water, an organic solvent, or a mixture thereof. Water is advantageously used.

If a mixture of alumina and silica is used in the present disclosure, the mixture may be prepared by mixing an alumina dispersion liquid and a silica dispersion liquid.

Binder

Examples of the binder contained in each ink receiving layer-forming liquid include starch derivatives, such as oxidized starch, etherified starch, and phosphoric acid-esterified starch; cellulose derivatives, such as carboxymethyl cellulose and hydroxyethyl cellulose; casein, gelatin, soy protein, polyvinyl alcohol, and derivatives thereof; latexes of polyvinyl pyrrolidone, maleic anhydride resin, and conjugated copolymers, such as styrene-butadiene copolymer and methyl methacrylate-butadiene copolymer; latexes of acrylic polymers, such as polymers of acrylic esters or methacrylic esters; latexes of vinyl polymers, such as ethylene-vinyl acetate copolymer; latexes of a functional group-modified polymer produced from a monomer having a functional group such as a carboxy group derived from the foregoing polymers; polymers produced by cationizing any of the foregoing polymers with a cationic group; cationized polymers produced by cationizing the surface of any of the foregoing polymers with a cationic surfactant; polymers produced by polymerizing any monomer of the foregoing polymers in the presence of a cationic polyvinyl alcohol, and distributing a polyvinyl alcohol over the surface thereof; polymers produced by polymerizing any monomer of the foregoing polymers in a cationic colloid particles-suspended dispersion, and distributing cationic colloid particles over the surface thereof; aqueous binders, such as melamine resin, urea resin, and other thermosetting synthesized resins; polymers or copolymers of acrylic esters or methacrylic esters, such as polymethyl methacrylate; and other synthetic resins, such as polyurethane resin, unsaturated polyester resin, vinyl chloride-vinyl acetate copolymer, polyvinyl butyral, and alkyd resin. These binders may be used singly or in combination.

Among these binders, polyvinyl alcohol and derivatives thereof are advantageous. Exemplary polyvinyl alcohol derivatives include cation-modified polyvinyl alcohols, anion-modified polyvinyl alcohols, silanol-modified polyvinyl alcohols, and polyvinyl acetal. A cation-modified polyvinyl alcohol having a primary to a tertiary amino group or a quaternary ammonium group in the main chain or a side chain thereof, as disclosed in Japanese Patent Laid-Open No. 61-10483 may be advantageously used.

The saponification degree of the polyvinyl alcohol may be in the range of 80% to 100% by mole, such as in the range of 85% by mole to 98% by mole. The saponification degree represents the proportion of the amount by mole of the hydroxy group in the polyvinyl alcohol produced by saponifying a polyvinyl acetate to the amount by mole of the polyvinyl alcohol. In the following description, a saponification degree refers to a value measured by the method specified in JIS K 6726.

The average polymerization degree of the polyvinyl alcohol may be 2,000 or more, and is desirably in the range of 2,000 to 5,000. The average polymerization degree mentioned herein is the viscosity average polymerization degree measured by the method specified in JIS K 6726.

For preparing each ink receiving layer-forming liquid, it is desirable that the binder or a derivative thereof be in the form of an aqueous solution. In this instance, the content of the binder or a derivative thereof in the aqueous solution is desirably in the range of 3% by mass to 20% by mass.

Zirconium Compound

Examples of the zirconium compound used herein include, but are not limited to, zirconium acetate, zirconium chloride, zirconium oxychloride, zirconium hydroxy chloride, zirconium nitrate, dizirconium dihydroxydioxo-carbonate, zirconium hydroxide, zirconium ammonium carbonate, zirconium potassium carbonate, zirconium sulfate, and zirconium fluoride.

Among these, zirconium acetate is superior in terms of miscibility with the ink receiving layer-forming liquid and ink absorbency. Zirconium acetate is commercially available, for example, as an aqueous solution ZA-30 (produced by Daiichi Kigenso Kagaku Kogyo).

Also, a water-soluble zirconium compound may be advantageously used in view of miscibility for preparing uniform ink receiving layer-forming liquid.

The recording medium of the present disclosure may contain other metal compounds in addition to the zirconium compound. Examples of metal compounds other than the zirconium compound include lithium, titanium, chromium, manganese, sodium, potassium, calcium, zinc, magnesium, and aluminum compounds. These metal compounds are desirably soluble in water.

Crosslinking Agent

The ink receiving layer may further contain a crosslinking agent. Examples of the crosslinking agent include aldehyde compounds, melamine compounds, isocyanate compounds, zirconium-based compounds, amide-based compounds, aluminum-based compounds, and boric acid and salts thereof. These crosslinking agents may be used singly or in combination. If polyvinyl alcohol or a derivative thereof is used as the binder, boric acid or a salt thereof is advantageously used.

Boric acid may be orthoboric acid ($H_3BO_3$), metaboric acid, and hypoboric acid. The boric acid salt is desirably a water-soluble salt of any of these boric acids. Examples of the boric acid salt include alkali metal salts, such as sodium borate and potassium borate; alkaline-earth metal salts, such as magnesium borate and calcium borate; and ammonium salts. Among these crosslinking agents, orthoboric acid is advantageous from the viewpoint of the stability of ink receiving layer-forming liquid with time and the effect of reducing the occurrence of cracks.

The amount of the crosslinking agent to be used can be appropriately controlled according to the manufacturing conditions and other factors. The proportion of the crosslinking agent to the binder in the ink receiving layer may be in the range of 1.0% by mass to 50% by mass, such as in the range of 5% by mass to 40% by mass, relative.

Other Ingredients

The ink receiving layer may further contain other ingredients or additives. Examples of such additives include a pH adjuster, a thickener, a fluidity improving agent, an antifoaming agent, a foam suppressor, a surfactant, a release agent, a penetrant, a coloring pigment, a coloring dye, a fluorescent brightening agent, an ultraviolet absorbent, an antioxidant, a preservative, a fungicide, a water-resistant additive, a dye fixing agent, a curing agent, and a weather-resistant material.

Undercoat Layer

In an embodiment of the present disclosure, an undercoat layer may be disposed between the substrate and the ink receiving layer from the viewpoint of increasing the adhesion between the substrate and the ink receiving layer. The undercoat layer may contain a water-soluble polyester resin, gelatin, and a binder. The thickness of the undercoat layer may be in the range of 0.01 μm to 5 μm.

Back Coat Layer

In an embodiment of the present disclosure, a back coat layer may be disposed on the surface of the substrate opposite the ink receiving layer in view of handling and easy conveyance, and from the viewpoint of increasing the resistance to rubbing when recording media in a stack are continuously subjected to printing. The back coat layer may contain a white pigment and a binder. The thickness of the back coat layer may be determined so that the amount of the liquid applied for forming the back coat layer becomes in the range of 1 $g/m^2$ to 25 $g/m^2$ after drying.

Method for Manufacturing Recording Medium

Although the recording medium of the present disclosure can be manufactured by any method without particular limitation, the method for manufacturing the recording medium may include preparing ink receiving layer-forming liquids, and applying the ink receiving layer-forming liquids onto the substrate. The method for manufacturing the recording medium will now be described.

Preparation of Substrate

The base paper of the substrate may be prepared by an ordinary paper making process. Exemplary paper-making machines include a Fourdrinier machine, a cylinder machine, a drum machine, and a twin wire machine. The base paper may be subjected to surface treatment to increase the smoothness of the surface thereof by applying heat and pressure during or after paper making. More specifically, the surface treatment may be performed by calendaring, such as machine calendering or super calendering.

For forming a resin layer over the base paper, that is, for coating the base paper with a resin, melt extrusion, wet lamination, or dry lamination may be applied. Melt extrusion, in which the base paper is coated by extruding a molten resin onto either or both sides of the base paper, is advantageous. For example, a method called extrusion coating is widely used. In this method, a conveyed base paper and a resin sheet extruded from an extrusion die are brought into contact with each other at a nip point between a nip roller and a cooling roller and pressed with the nip so that the base paper is coated with the resin. If the resin layer is formed by melt extrusion, pretreatment may be performed to increase the adhesion between the base paper and the resin layer. The pretreatment may be performed by acid etching with a mixed solution of sulfuric acid and chromic acid, gas flame treatment, UV exposure, corona discharge, glow discharge, or anchor coating of, for example, alkyl titanate. Among these pretreatment techniques, corona discharge treatment is advantageous. If a resin layer containing a white pigment is formed, the base paper may be coated with a mixture of a resin and the white pigment.

The process for preparing the substrate may further include winding the substrate formed as just described on a core before forming the ink receiving layer. The core may have a diameter in the range of 50 mm to 300 mm. The tension for winding may be in the range of 50 N/m to 800 N/m. The tension may be constant from the beginning of the winding to the end of the winding. Alternatively, the tension may be gradually reduced from the beginning of the winding to the end of the winding so as to reduce pressure concentration at the start point of winding.

Formation of Ink Receiving Layer

The ink receiving layer may be formed on the substrate according to the following procedure. First, ink receiving layer-forming liquids are prepared. Then, each coating liquid is applied to the substrate and is then dried to yield the recording medium.

The ink receiving layer-forming liquids may be applied by a known method. For example, the liquids are applied by slot die coating, slide hopper coating, curtain coating, extrusion coating, air knife coating, roll coating, or rod bar coating. The first and the second ink receiving layer-forming liquid may be applied and dried one after the other, or may be applied simultaneously. Slide hopper coating and curtain coating are highly productive and are therefore advantageous.

The liquids may be heated during being applied. For drying the applied liquid, a hot air dryer may be used, or any other dryer may be used, such as IR dryer, heating dryer, or microwave dryer. Examples of the hot air dryer include a linear tunnel dryer, an arch dryer, an air loop dryer, and a sine curve air flow dryer.

The recording medium according to an embodiment of the present disclosure allows image density to be increased and reduces bronzing while the occurrence of cracks in the ink receiving layer is reduces.

EXAMPLES

The subject matter of the present disclosure will be further described in detail with reference to Examples and Comparative Examples. The subject matter is however not limited to the following Examples. In the following Examples, "part(s)" is on a mass basis unless otherwise specified.

Preparation of Recording Media

Preparation of Substrate

A paper stock was prepared by mixing 80 parts of LBKP having a Canadian standard freeness of 450 mL, 20 parts of NBKP having a Canadian standard freeness of 480 mL, 0.60 part of cationized starch, 10 parts of ground calcium carbonate, 15 parts of precipitated calcium carbonate, 0.10 part of alkyl ketene dimer, and 0.030 part of cationic polyacrylamide, and adding water to the mixture so as to have a solid content of 3.0% by mass. Subsequently, paper making using the paper stock was performed with a Fourdrinier machine, followed by three-step wet press and drying with a multi-cylinder dryer. Then, the resulting sheet was soaked with an aqueous solution of oxidized starch and dried so that the solid content after drying with a size press machine would be 1.0 $g/m^2$. The sheet was then finished by machine calendering to yield a 100 μm thick base paper having a basis weight of 170 $g/m^2$, a Stöckigt sizing degree of 100 s, an air permeance of 50 s, a Bekk smoothness of 30 s, and a Gurley stiffness of 11.0 mN. Subsequently, a resin composition containing 70 parts of a low-density polyethylene, 20 parts of a high-density polyethylene, and 10 parts of titanium oxide was applied onto one side of the base paper so that the amount of the coating would be 25 $g/m^2$ after being dried. The side of the base paper coated with this resin composition was used as the upper side. Subsequently, a low-density polyethylene was applied onto the other side of the base paper to yield a substrate.

Preparation of Ink Receiving Layer-Forming Liquids

Preparation of Alumina (Hydrated Almina) Dispersion Liquid 1:

To 498 parts of ion exchanged water, 2 parts of acetic acid was added. While this acetic acid aqueous solution was stirred with a homogenizing mixer (T. K. Homo Mixer MARK II model 2.5, manufactured by Primix) at 3000 rpm, 100 parts of hydrated alumina (DISPERAL HP14, produced by Sasol) was slowly added to the acetic acid aqueous solution.

After the completion of adding, the mixture was stirred for 30 minutes to yield alumina dispersion liquid 1 in which alumina was deflocculated in acetic acid. The solids content in alumina dispersion liquid 1 was 23% by mass.

Preparation of Alumina (Fumed Almina) Dispersion Liquid 2:

To 498 parts of ion exchanged water, 1.5 parts of acetic acid was added. While this acetic acid aqueous solution was stirred with a homogenizing mixer (T. K. Homo Mixer MARK II model 2.5, manufactured by Primix) at 3000 rpm, 100 parts of fumed alumina (AEROXIDE Alu C, produced by EVONIK) was slowly added to the acetic acid aqueous solution.

After the completion of adding, the mixture was stirred for 30 minutes to yield alumina dispersion liquid 2 in which alumina was deflocculated in acetic acid. The solids content in alumina dispersion liquid 2 was 23% by mass.

Preparation of Fumed Silica Dispersion Liquid:

To 333 parts of ion exchanged water, 4.0 parts of a cationic polymer (SHALLOL DC-902P, produced by Dai-ichi Kogyo Seiyaku) was added to yield a cationic polymer aqueous solution. While this cationic polymer aqueous solution was stirred with a homogenizing mixer (T. K. Homo Mixer MARK II model 2.5, manufactured by Primix) at 3000 rpm, 100 parts of fumed silica (AEROSIL 300, produced by EVONIK) was slowly added to the cationic polymer aqueous solution. After the completion of adding, the resulting mixture was diluted with ion exchanged water and further treated twice with a high-pressure homogenizer (Nanomizer, available from Yoshida Kikai) to yield a fumed silica dispersion liquid. The solids content in the fumed silica dispersion liquid was 20% by mass.

Preparation of Wet Process Silica Dispersion Liquid:

To 333 parts of ion exchanged water, 4.0 parts of a cationic polymer (SHALLOL DC-902P, produced by Dai-ichi Kogyo Seiyaku) was added to yield a cationic polymer aqueous solution. While this cationic polymer aqueous solution was stirred with a homogenizing mixer (T. K. Homo Mixer MARK II model 2.5, manufactured by Primix) at 3000 rpm, 100 parts of wet silica (NIPGEL BY-601, produced by Tosho Silica) was slowly added to the cationic polymer aqueous solution. After the completion of adding, the resulting mixture was diluted with ion exchanged water to yield a wet process silica dispersion liquid. The solids content in the wet process silica dispersion liquid was 20% by mass.

Other Dispersion Liquid and Aqueous Solutions:

Commercially available dispersion liquid and aqueous solutions shown in Table 1 were prepared.

TABLE 1

| Dispersion liquid or aqueous solution | Product name | Solids content (mass %) |
|---|---|---|
| Colloidal silica dispersion liquid | CORTACOAT K303C, produced by Clariant | 30 |
| Zirconium nitrate aqueous solution | Zircosol ZN, produced by Daiichi Kigenso Kagaku Kogyo | 25 |
| Zirconium oxychloride aqueous solution | Zircosol ZC-2, produced by Daiichi Kigenso Kagaku Kogyo | 35 |
| Zirconium acetate aqueous solution | Zircosol ZA-30, produced by Daiichi Kigenso Kagaku Kogyo | 30 |
| Polyaluminum chloride aqueous solution | HAP 25, produced by Rikengreen | 25 |
| Cationic polymer aqueous solution | Sharoll DC 902P, produced by Dai-ichi Kogyo Seiyaku | 50 |
| Polyvinyl alcohol aqueous solution | PVA 235, produced by Kuraray | 8 |
| Orthoboric acid aqueous solution | Borax, produced by U.S. Borax | 5 |

Preparation of First Ink Receiving Layer-Forming Liquids (Liquids A1 to A3 and A5 to A20):

Liquids A1 to A3 and A5 to A20 were prepared by mixing the dispersion liquids and solutions described above so that each content in a solid basis would be the value shown in Table 2.

TABLE 2

| First ink receiving layer-forming liquid | Inorganic particles: Silica Type | Silica Proportion (mass parts) | Alumina Type | Alumina Proportion (mass parts) | Polyvinyl alcohol Proportion (mass parts) | Orthoboric acid Proportion (mass parts) | Additive Type | Additive Proportion (mass part(s)) | Total (mass parts) | Zirconium compound content in first ink receiving layer (mass %) |
|---|---|---|---|---|---|---|---|---|---|---|
| Liquid A1 | Fumed silica | 50 | Hydrated alumina | 50 | 18 | 2.5 | Zirconium acetate | 0.5 | 121.0 | 0.41 |
| Liquid A2 | Fumed silica | 40 | Hydrated alumina | 60 | 18 | 2.5 | Zirconium acetate | 0.5 | 121.0 | 0.41 |
| Liquid A3 | Fumed silica | 60 | Hydrated alumina | 40 | 18 | 2.5 | Zirconium acetate | 0.5 | 121.0 | 0.41 |
| Liquid A5 | Fumed silica | 50 | Hydrated alumina | 50 | 18 | 2.5 | Zirconium acetate | 1.5 | 122.0 | 1.23 |
| Liquid A6 | Fumed silica | 50 | Hydrated alumina | 50 | 18 | 2.5 | Zirconium acetate | 2 | 122.5 | 1.63 |
| Liquid A7 | Fumed silica | 50 | Hydrated alumina | 50 | 18 | 2.5 | Zirconium nitrate | 0.5 | 121.0 | 0.41 |
| Liquid A8 | Fumed silica | 50 | Hydrated alumina | 50 | 18 | 2.5 | Zirconium oxychloride | 0.5 | 121.0 | 0.41 |

TABLE 2-continued

| First ink receiving layer-forming liquid | Inorganic particles: Silica Type | Silica Proportion (mass parts) | Alumina Type | Alumina Proportion (mass parts) | Polyvinyl alcohol Proportion (mass parts) | Orthoboric acid Proportion (mass parts) | Additive Type | Additive Proportion (mass part(s)) | Total (mass parts) | Zirconium compound content in first ink receiving layer (mass %) |
|---|---|---|---|---|---|---|---|---|---|---|
| Liquid A9 | Fumed silica | 50 | Fumed alumina | 50 | 18 | 2.5 | Zirconium acetate | 0.5 | 121.0 | 0.41 |
| Liquid A10 | Fumed silica | 70 | Hydrated alumina | 30 | 21 | 2.9 | Zirconium acetate | 0.5 | 124.4 | 0.40 |
| Liquid A11 | Fumed silica | 100 | — | 0 | 23 | 3.2 | Zirconium acetate | 0.5 | 126.7 | 0.39 |
| Liquid A12 | Fumed silica | 30 | Hydrated alumina | 70 | 13 | 1.8 | Zirconium acetate | 0.5 | 115.3 | 0.43 |
| Liquid A13 | — | 0 | Hydrated alumina | 100 | 10 | 1.4 | Zirconium acetate | 0.5 | 111.9 | 0.45 |
| Liquid A14 | Colloidal silica | 50 | Hydrated alumina | 50 | 18 | 2.5 | Zirconium acetate | 0.5 | 121.0 | 0.41 |
| Liquid A15 | Wet process silica | 50 | Hydrated alumina | 50 | 18 | 2.5 | Zirconium acetate | 0.5 | 121.0 | 0.41 |
| Liquid A16 | Fumed silica | 50 | Hydrated alumina | 50 | 18 | 2.5 | — | 0 | 120.5 | 0 |
| Liquid A17 | Fumed silica | 50 | Hydrated alumina | 50 | 18 | 2.5 | Polyaluminum chloride | 0.5 | 121.0 | 0.41 |
| Liquid A18 | Fumed silica | 50 | Hydrated alumina | 50 | 18 | 2.5 | Cationic polymer | 0.5 | 121.0 | 0.41 |
| Liquid A19 | Fumed silica | 50 | Hydrated alumina | 50 | 18 | 2.5 | Zirconium acetate | 0.1 | 120.6 | 0.08 |
| Liquid A20 | Fumed silica | 50 | Hydrated alumina | 50 | 18 | 2.5 | Zirconium acetate | 4 | 124.5 | 3.21 |

Preparation of Second Ink Receiving Layer-Forming Liquids (Liquids B1, B2, and B4 to B11):

Liquids B1, B2 and B4 to B11 were prepared by mixing the dispersion liquids and solutions described above so that each content in a solid basis would be the value shown in Table 3.

For the liquids containing fumed silica, colloidal silica or wet process silica shown in Tables 2 and 3, the above-described fumed silica dispersion liquid, colloidal silica dispersion liquid or wet process silica dispersion liquid was used. For the liquids containing hydrated alumina or fumed alumina shown in Tables 2 and 3, the above-described alumina dispersion liquid 1 or 2 was used.

Application and Drying of Ink Receiving Layer-Forming Liquid:

The first ink receiving layer-forming liquid and the second ink receiving layer-forming liquid prepared according to Tables 2 and 3 were applied so that the first ink receiving layer and the second ink receiving layer would be disposed in this order from the side close to the substrate. For the recording medium further including a third ink receiving layer, the first ink receiving layer-forming liquid, the second ink receiving layer-forming liquid, and the third ink receiving layer-forming liquid were applied so that the first ink receiving layer, the second ink receiving layer, and the third ink receiving layer would be disposed in this order from the side close to the substrate.

TABLE 3

| Second ink receiving layer-forming liquid | Inorganic particles: Silica Type | Silica Content (parts by mass) | Alumina Type | Alumina Content (parts by mass) | Polyvinyl alcohol Content (parts by mass) | Orthoboric acid Content (parts by mass) |
|---|---|---|---|---|---|---|
| Liquid B1 | Fumed silica | 100 | — | 0 | 23 | 3.2 |
| Liquid B2 | — | 0 | Hydrated alumina | 100 | 10 | 1.4 |
| Liquid B4 | Fumed silica | 80 | Hydrated alumina | 20 | 22 | 3 |
| Liquid B5 | Fumed silica | 20 | Hydrated alumina | 80 | 12 | 1.6 |
| Liquid B6 | — | 0 | Fumed alumina | 100 | 12 | 1.6 |
| Liquid B7 | Colloidal silica | 100 | — | 0 | 10 | 1.4 |
| Liquid B8 | Wet process silica | 100 | — | 0 | 30 | 1.4 |
| Liquid B9 | Fumed silica | 50 | Hydrated alumina | 50 | 18 | 2.5 |
| Liquid B10 | Fumed silica | 75 | Hydrated alumina | 25 | 21 | 2.9 |
| Liquid B11 | Fumed silica | 25 | Hydrated alumina | 75 | 13 | 1.8 |

The amount of each liquid applied was adjusted so that the dried coating layer would have a weight (g/m$^2$) shown in Tables 4 and 5. The first and the second ink receiving layer-forming liquid or the first, the second, and the third ink receiving layer-forming liquid were simultaneously applied by simultaneous multilayer coating method using a multi-layer slide hopper coating apparatus. After the application of the first and the second ink receiving layer-forming liquid or the first, the second, and the third ink receiving layer-forming liquid, the applied liquids were dried with hot air at 120° C. Thus, recording media 1, 2, 5 to 15, and 18 to 45 were produced.

TABLE 4

| | | First ink receiving layer | | | Second ink receiving layer | | | Third ink receiving layer | | |
|---|---|---|---|---|---|---|---|---|---|---|
| | | Liquid | Applied amount g/m$^2$ | Thickness μm | Liquid | Applied amount g/m$^2$ | Thickness μm | Liquid | Applied amount g/m$^2$ | Thickness μm |
| Example 1 | Recording medium 1 | A1 | 25 | 32 | B1 | 1 | 1.5 | — | — | — |
| Example 2 | Recording medium 2 | A1 | 25 | 32 | B2 | 1.5 | 1.5 | — | — | — |
| Example 5 | Recording medium 5 | A2 | 25 | 34 | B1 | 1 | 1.5 | — | — | — |
| Example 6 | Recording medium 6 | A3 | 25 | 30 | B1 | 1 | 1.5 | — | — | — |
| Example 7 | Recording medium 7 | A1 | 25 | 32 | B4 | 1 | 1.4 | — | — | — |
| Example 8 | Recording medium 8 | A1 | 25 | 32 | B5 | 1.5 | 1.5 | — | — | — |
| Example 9 | Recording medium 9 | A1 | 25 | 32 | B6 | 1.5 | 1.5 | — | — | — |
| Example 10 | Recording medium 10 | A1 | 25 | 32 | B1 | 3.3 | 5.0 | — | — | — |
| Example 11 | Recording medium 11 | A1 | 25 | 32 | B1 | 2 | 3.0 | — | — | — |
| Example 12 | Recording medium 12 | A1 | 25 | 32 | B1 | 0.8 | 1.2 | — | — | — |
| Example 13 | Recording medium 13 | A1 | 25 | 32 | B1 | 0.65 | 1.0 | — | — | — |
| Example 14 | Recording medium 14 | A1 | 25 | 32 | B1 | 0.35 | 0.5 | — | — | — |
| Example 15 | Recording medium 15 | A1 | 25 | 32 | B1 | 0.2 | 0.3 | — | — | — |
| Example 18 | Recording medium 18 | A5 | 25 | 32 | B1 | 1 | 1.5 | — | — | — |
| Example 19 | Recording medium 19 | A6 | 25 | 32 | B1 | 1 | 1.5 | — | — | — |
| Example 20 | Recording medium 20 | A7 | 25 | 32 | B1 | 1 | 1.5 | — | — | — |
| Example 21 | Recording medium 21 | A8 | 25 | 32 | B1 | 1 | 1.5 | — | — | — |
| Example 22 | Recording medium 22 | A9 | 25 | 32 | B1 | 1 | 1.5 | — | — | — |
| Example 23 | Recording medium 23 | A1 | 25 | 32 | B1 | 1 | 1.5 | B2 | 1.5 | 1.5 |
| Example 24 | Recording medium 24 | A1 | 25 | 32 | B1 | 1 | 1.5 | B1 | 1 | 1.5 |
| Example 25 | Recording medium 25 | A1 | 25 | 32 | B2 | 1.5 | 1.5 | B1 | 1 | 1.5 |
| Example 26 | Recording medium 26 | A1 | 25 | 32 | B1 | 1 | 1.5 | B5 | 1.5 | 1.5 |
| Example 27 | Recording medium 27 | A1 | 25 | 32 | B1 | 1 | 1.5 | B4 | 1 | 1.5 |
| Comparative Example 1 | Recording medium 28 | A10 | 25 | 35 | B1 | 1 | 1.5 | — | — | — |
| Comparative Example 2 | Recording medium 29 | A11 | 25 | 37 | B1 | 1 | 1.5 | — | — | — |
| Comparative Example 3 | Recording medium 30 | A12 | 25 | 29 | B1 | 1 | 1.5 | — | — | — |
| Comparative Example 4 | Recording medium 31 | A13 | 25 | 25 | B1 | 1 | 1.5 | — | — | — |
| Comparative Example 5 | Recording medium 32 | A14 | 25 | 22 | B1 | 1 | 1.5 | — | — | — |
| Comparative Example 6 | Recording medium 33 | A15 | 25 | 37 | B1 | 1 | 1.5 | — | — | — |
| Comparative Example 7 | Recording medium 34 | A1 | 25 | 32 | B7 | 2 | 1.3 | — | — | — |
| Comparative Example 8 | Recording medium 35 | A1 | 25 | 32 | B8 | 1 | 1.5 | — | — | — |
| Comparative Example 9 | Recording medium 36 | A1 | 25 | 32 | — | 0 | 0 | — | — | — |
| Comparative Example 10 | Recording medium 37 | — | 0 | 0 | B1 | 28 | 40.0 | — | — | — |
| Comparative Example 11 | Recording medium 38 | A1 | 25 | 32 | B9 | 1 | 1.3 | — | — | — |
| Comparative Example 12 | Recording medium 39 | A16 | 25 | 32 | B1 | 1 | 1.5 | — | — | — |
| Comparative Example 13 | Recording medium 40 | A1 | 25 | 32 | B10 | 1 | 1.4 | — | — | — |
| Comparative Example 14 | Recording medium 41 | A1 | 25 | 32 | B11 | 1.5 | 1.6 | — | — | — |
| Comparative Example 15 | Recording medium 42 | A17 | 25 | 32 | B1 | 1 | 1.5 | — | — | — |
| Comparative Example 16 | Recording medium 43 | A18 | 25 | 32 | B1 | 1 | 1.5 | — | — | — |
| Comparative Example 17 | Recording medium 44 | A19 | 25 | 32 | B1 | 1 | 1.5 | — | — | — |
| Comparative Example 18 | Recording medium 45 | A20 | 25 | 32 | B1 | 1 | 1.5 | — | — | — |

TABLE 5

| | | First ink receiving layer thickness/ Second ink receiving layer thickness |
|---|---|---|
| Example 1 | Recording medium 1 | 21.3 |
| Example 2 | Recording medium 2 | 21.3 |
| Example 5 | Recording medium 5 | 22.7 |
| Example 6 | Recording medium 6 | 20.0 |
| Example 7 | Recording medium 7 | 22.9 |
| Example 8 | Recording medium 8 | 21.3 |
| Example 9 | Recording medium 9 | 21.3 |
| Example 10 | Recording medium 10 | 6.4 |
| Example 11 | Recording medium 11 | 10.7 |
| Example 12 | Recording medium 12 | 26.7 |
| Example 13 | Recording medium 13 | 32.0 |
| Example 14 | Recording medium 14 | 64.0 |
| Example 15 | Recording medium 15 | 106.7 |
| Example 18 | Recording medium 18 | 21.3 |
| Example 19 | Recording medium 19 | 21.3 |
| Example 20 | Recording medium 20 | 21.3 |
| Example 21 | Recording medium 21 | 21.3 |
| Example 22 | Recording medium 22 | 21.3 |
| Example 23 | Recording medium 23 | 21.3 |
| Example 24 | Recording medium 24 | 21.3 |
| Example 25 | Recording medium 25 | 21.3 |
| Example 26 | Recording medium 26 | 21.3 |
| Example 27 | Recording medium 27 | 21.3 |
| Comparative Example 1 | Recording medium 28 | 23.3 |
| Comparative Example 2 | Recording medium 29 | 24.7 |
| Comparative Example 3 | Recording medium 30 | 19.3 |
| Comparative Example 4 | Recording medium 31 | 16.7 |
| Comparative Example 5 | Recording medium 32 | 14.7 |
| Comparative Example 6 | Recording medium 33 | 24.7 |
| Comparative Example 7 | Recording medium 34 | 24.6 |
| Comparative Example 8 | Recording medium 35 | 21.3 |
| Comparative Example 9 | Recording medium 36 | — |
| Comparative Example 10 | Recording medium 37 | 0 |
| Comparative Example 11 | Recording medium 38 | 24.6 |
| Comparative Example 12 | Recording medium 39 | 21.3 |
| Comparative Example 13 | Recording medium 40 | 22.9 |
| Comparative Example 14 | Recording medium 41 | 20.0 |
| Comparative Example 15 | Recording medium 42 | 21.3 |
| Comparative Example 16 | Recording medium 43 | 21.3 |
| Comparative Example 17 | Recording medium 44 | 21.3 |
| Comparative Example 18 | Recording medium 45 | 21.3 |

Examples 1, 2, 5 to 15, and 18 to 27 and Comparative Examples 1 to 18

Recording media 1, 2, 5 to 15, and 18 to 43 were subjected to the following examinations 1 to 4. The evaluation results are shown in Table 6.

Evaluation

For evaluation of each examination (except for 20° glossiness), ratings AA to B represent good levels, and ratings C and D represent unacceptable levels. For recording the image on the recording medium in each examination, an ink jet recording apparatus PIXUS MP 990 (manufactured by Canon) with an ink cartridge BCI-321 (manufactured by Canon) was used. Mages were recorded at 23° C. and a relative humidity of 50%. In the use of the above-mentioned ink jet recording apparatus, the duty of recording performed in such a manner that an ink droplet of about 11 ng is applied to a unit area of 1/600 inch×1/600 inch at a resolution of 600 dpi×600 dpi is defined as 100%.

Examination 1: Cracks in Ink Receiving Layer

The degree of cracks in the ink receiving layer was examined by observing the surface of the ink receiving layer of each of the recording media was observed, and evaluated according to the following criteria. The evaluation results are shown in Table 5.

Criteria:

AA: No cracks were observed.

A: Cracks observed through a loupe were so small as to be invisible to the naked eye.

B: Some of the cracks observed in the ink receiving layer were visible to the naked eye.

C: Cracks were visible to the naked eye throughout the entire surface of the ink receiving layer.

D: Innumerable large cracks were observed, and the ink receiving layer was partially separated from the substrate.

Examination 2: Image Density

A black solid pattern was printed on the side of each recording medium on which the ink receiving layer was disposed by using an ink jet recording apparatus (MP990, manufactured by Canon) in Gloss Pro Platinum Grade and a no color correction mode. The optical density of the surface of each recording medium on which the solid pattern had been formed was measured with an optical reflection densitometer (530 Spectrodensitometer, manufactured by X-Rite). The evaluation results are shown in Table 5.

Criteria:

AA: Optical density was 2.30 or more.

A: Optical density was in the range of 2.20 to less than 2.30.

B: Optical density was in the range of 2.10 to less than 2.20.

C: Optical density was in the range of 2.00 to less than 2.10.

D: Optical density was less than 2.00.

Examination 3: Bronzing

A cyan solid pattern was printed on the side of each recording medium on which the ink receiving layer was disposed by using an ink jet recording apparatus (MP990, manufactured by Canon) in Gloss Pro Platinum Grade and a no color correction mode. Whether bronzing occurred was visually observed, and the state of the bronzing was evaluated according to the following criteria. The evaluation results are shown in Table 5.

Criteria:

AA: No bronzing was observed.

A: Reflected light was slightly reddish.

B: Reflected light was reddish.

C: Metallic lustrous bronzing occurred.

D: Metallic lustrous bronzing occurred and the gloss of the printed solid pattern was reduced.

Examination 4: 20° Gloss

The 20° gloss of the printed surface (the side on which the ink receiving layer (and the uppermost surface) was disposed) of each recording medium was measured in accordance with JIS Z 8741. For the measurement, a gloss meter VG 2000 manufactured by Nippon Denshoku Industries was used. When a glossy photographic paper exhibits a 20° gloss of 10% or more, the photographic paper is considered to be favorable in gloss. Also, the higher the 20° gloss, the higher the quality.

TABLE 6

| | | Evaluation | | | |
|---|---|---|---|---|---|
| | | Cracks | Image density | Bronzing | Gloss (%) |
| Example 1 | Recording medium 1 | AA | AA | AA | 16 |
| Example 2 | Recording medium 2 | AA | AA | AA | 25 |
| Example 5 | Recording medium 5 | A | AA | AA | 16 |
| Example 6 | Recording medium 6 | A | AA | AA | 15 |
| Example 7 | Recording medium 7 | AA | B | AA | 13 |
| Example 8 | Recording medium 8 | AA | A | AA | 25 |
| Example 9 | Recording medium 9 | AA | B | AA | 22 |
| Example 10 | Recording medium 10 | B | AA | AA | 16 |
| Example 11 | Recording medium 11 | A | AA | AA | 16 |
| Example 12 | Recording medium 12 | AA | A | A | 16 |
| Example 13 | Recording medium 13 | AA | B | A | 16 |
| Example 14 | Recording medium 14 | AA | B | A | 17 |
| Example 15 | Recording medium 15 | AA | B | B | 16 |
| Example 18 | Recording medium 18 | A | AA | AA | 16 |
| Example 19 | Recording medium 19 | B | A | AA | 16 |
| Example 20 | Recording medium 20 | B | A | B | 15 |
| Example 21 | Recording medium 21 | B | B | B | 16 |
| Example 22 | Recording medium 22 | B | AA | AA | 16 |
| Example 23 | Recording medium 23 | AA | AA | AA | 36 |
| Example 24 | Recording medium 24 | AA | AA | AA | 16 |
| Example 25 | Recording medium 25 | AA | AA | AA | 25 |
| Example 26 | Recording medium 26 | AA | A | AA | 33 |
| Example 27 | Recording medium 27 | AA | A | AA | 13 |
| Comparative Example 1 | Recording medium 28 | C | AA | AA | 16 |
| Comparative Example 2 | Recording medium 29 | D | AA | AA | 15 |
| Comparative Example 3 | Recording medium 30 | A | AA | C | 15 |
| Comparative Example 4 | Recording medium 31 | AA | AA | C | 16 |
| Comparative Example 5 | Recording medium 32 | AA | D | D | 16 |
| Comparative Example 6 | Recording medium 33 | C | D | AA | 16 |
| Comparative Example 7 | Recording medium 34 | AA | D | D | 19 |
| Comparative Example 8 | Recording medium 35 | AA | C | AA | 3 |
| Comparative Example 9 | Recording medium 36 | AA | D | D | 15 |
| Comparative Example 10 | Recording medium 37 | D | AA | B | 16 |
| Comparative Example 11 | Recording medium 38 | AA | D | C | 15 |
| Comparative Example 12 | Recording medium 39 | C | B | C | 14 |
| Comparative Example 13 | Recording medium 40 | AA | C | C | 17 |
| Comparative Example 14 | Recording medium 41 | AA | C | D | 22 |
| Comparative Example 15 | Recording medium 42 | AA | B | D | 15 |
| Comparative Example 16 | Recording medium 43 | AA | B | D | 15 |
| Comparative Example 17 | Recording medium 44 | C | B | D | 16 |
| Comparative Example 18 | Recording medium 45 | D | B | AA | 17 |

Table 6 shows that the recording media 1, 2, 5 to 15, and 18 to 27, which are the recording media according to the present disclosure, exhibited reduced cracks in the ink receiving layer and reduced bronzing, and on which high-density images were formed. When, in the second ink receiving layer, fumed silica accounts for 80% by mass or more of the inorganic particles in the second ink receiving layer, the gloss was lower than the case where alumina accounts for 80% by mass or more of the inorganic particles in the second ink receiving layer (as shown in, for example, the comparison between Examples 1 and 2). When fumed silica accounts for 80% by mass or more in the second ink receiving layer and the recording medium further includes a third ink receiving layer in which alumina accounts for 80% by mass or more, particularly high gloss was exhibited (Examples 23 and 26).

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-078261, filed Apr. 8, 2016, No. 2016-078262, filed Apr. 8, 2016, and No. 2016-186137, filed Sep. 23, 2016, which are hereby incorporated by reference herein in their entirety.

What is claimed is:

1. A recording medium comprising:

a substrate; and a first and a second ink receiving layer over the substrate in this order from the side close to the substrate, wherein the first ink receiving layer contains fumed silica, alumina, and a zirconium compound, the mass ratio of the fumed silica to the alumina is in the range of 40:60 to 60:40, and the zirconium compound content in the first ink receiving layer is in the range of 0.1% by mass to 3.0% by mass relative to the total mass of the first ink receiving layer, and wherein the second ink receiving layer contains inorganic particles including at least one of fumed silica and alumina, and the fumed silica or the alumina accounts for 80% by mass or more of the inorganic particles in the second ink receiving layer.

2. The recording medium according to claim 1, wherein ratio of the thickness of the first ink receiving layer to the thickness of the second ink receiving layer is in the range of 10 to 30.

3. The recording medium according to claim 1, wherein the thickness of the second ink receiving layer is in the range of 0.5 μm to 3.0 μm.

4. The recording medium according to claim 1, wherein the zirconium compound in the first ink receiving layer is zirconium acetate.

5. The recording medium according to claim 1, wherein the alumina in the first ink receiving layer is hydrated alumina.

6. The recording medium according to claim 1, further comprising a third ink receiving layer over the second ink receiving layer, the third ink receiving layer containing inorganic particles including alumina, the proportion of the alumina being 80% by mass or more relative to the inorganic particles in the third ink receiving layer, wherein the second ink receiving layer contains fumed silica with a proportion of 80% by mass or more relative to the inorganic particles contained in the second ink receiving layer.

7. The recording medium according to claim 1, wherein the zirconium compound content in the first ink receiving layer is in the range of 0.3% by mass to 3.0% by mass relative to the total mass of the first ink receiving layer.

8. The recording medium according to claim 1, wherein the second ink receiving layer contains a zirconium compound in the range of 0.3% by mass to 3.0% by mass relative to the total mass of the first ink receiving layer.

9. The recording medium according to claim 8, wherein the zirconium compound in the second ink receiving layer is zirconium acetate.

10. The recording medium according to claim 1, wherein ratio of the thickness of the first ink receiving layer to the thickness of the second ink receiving layer is in the range of 20 to 30.

11. The recording medium according to claim 1, wherein the thickness of the second ink receiving layer is in the range of 0.5 μm to 1.5 μm.

12. The recording medium according to claim 1, wherein the first ink receiving layer contains a binder.

13. The recording medium according to claim 12, wherein the proportion of the binder to inorganic particles in the first ink receiving layer is in the range of 10.0% by mass to 40.0% by mass.

14. The recording medium according to claim 1, wherein the second ink receiving layer contains a binder.

15. The recording medium according to claim 14, wherein the proportion of the binder to the inorganic particles in the second ink receiving layer is in the range of 5.0% by mass to 30.0% by mass.

16. The recording medium according to claim 1, wherein the second ink receiving layer contains the fumed silica, and the fumed silica accounts for 80% by mass or more of the inorganic particles in the second ink receiving layer.

17. The recording medium according to claim 1, wherein a content of the inorganic particles in the first ink receiving layer is in the range of 50% by mass to 98% by mass relative to the total mass of the first ink receiving layer.

18. The recording medium according to claim 1, wherein a content of the inorganic particles in the second ink receiving layer is in the range of 50% by mass to 98% by mass relative to the total mass of the second ink receiving layer.

* * * * *